US005098015A

United States Patent [19]

Calvert

[11] Patent Number: 5,098,015

[45] Date of Patent: Mar. 24, 1992

[54] SLEEVE TYPE CARTON

[75] Inventor: Rodney K. Calvert, Dunwoody, Ga.

[73] Assignee: The Mead Corporation, Dayton, Ohio

[21] Appl. No.: 774,492

[22] Filed: Oct. 10, 1991

Related U.S. Application Data

[60] Division of Ser. No. 547,482, Jul. 3, 1990, which is a continuation-in-part of Ser. No. 434,190, Nov. 13, 1989, Pat. No. 5,019,029.

[51] Int. Cl.[5] ..... B65D 5/06

[52] U.S. Cl. ..... 229/126; 229/40; 229/900

[58] Field of Search ..... 229/40, 126, 162, 900, 229/917, 120, DIG. 14; 493/309, 312, 315, 316, 318

[56] References Cited

U.S. PATENT DOCUMENTS

| | | | |
|---|---|---|---|
| 3,190,193 | 6/1965 | Randles, Jr. | 493/312 |
| 3,457,843 | 7/1969 | Bower | 493/309 |
| 3,750,931 | 8/1973 | Dick | 229/917 |
| 3,991,660 | 11/1976 | Calvert et al. | 493/316 |
| 4,371,366 | 2/1983 | Bower et al. | 229/120 |
| 4,489,878 | 12/1984 | Mode | 229/120 |
| 4,744,507 | 5/1988 | Morsbach | 229/40 |
| 5,019,029 | 5/1991 | Calvert | 493/315 |

FOREIGN PATENT DOCUMENTS

| | | | |
|---|---|---|---|
| 157858 | 9/1978 | Netherlands | 229/40 |

OTHER PUBLICATIONS

Research Disclosures, NO18548, Sep. 1979.

*Primary Examiner*—Gary E. Elkins
*Attorney, Agent, or Firm*—Rodgers & Rodgers

[57] ABSTRACT

A method for withdrawing from a hopper collapsed sleeve type end loading cartons having face contacting panels in one of which panels a pair of apertures are formed and for initiating set up of the carton into open ended condition, the method comprising sequentially engaging and withdrawing collapsed cartons from the hopper with pick up devices slidably mounted on a pair of support rods, arranged so that one end of each support rod extends through one aperture in one of the face contacting carton panels and into engagement with the other face contacting panel so as to initiate a set up condition of the carton.

7 Claims, 7 Drawing Sheets

SLEEVE TYPE CARTON

This is a division of application Ser. No. 07/547,482, filed July 3, 1990 pending which is a continuation-in-part of U.S. Pat. application No. 434,190 filed Nov. 13, 1989, now U.S. Pat. No. 5,019,029 issued 5/28/91.

TECHNICAL FIELD

This invention relates to packaging of articles such as cans or bottles in end loading sleeve type cartons and is concerned more particularly with a method for feeding specially constructed collapsed cartons from a hopper and for setting up such collapsed cartons into open ended condition for subsequent loading through one or both ends of the sleeve.

BACKGROUND ART

U.S. Pat. No. 3,575,409 issued April 20, 1971 and owned by the assignee of this invention discloses a feeder mechanism for withdrawing cartons from a hopper. This patent does not perform a set up operation for a sleeve type collapsed carton blank.

U S. Pat. No. 3,991,660 issued Nov. 16, 1976 and owned by the assignee of this invention discloses a feeder mechanism which withdraws a collapsed carton from a hopper and initiates set up of the carton by utilizing a main feeder arm in cooperation with a supplementary feeder arm.

SUMMARY OF THE INVENTION

According to this invention in one form, collapsed sleeve type cartons are withdrawn from a hopper in sequence by a pair of pick up devices slidably mounted respectively on a pair of rotatable elongated support rods which enter apertures formed in an exposed wall of the carton blank and which are spaced apart by a distance equal to the distance between said support rods to permit said rods to engage a face contacting panel to initiate set up movement in coordination with sliding movement of the carton pick up means in a direction away from the hopper. Completion of the set up operation is effected by depositing the partially set up carton between a leading and a trailing flight bar which bars grip oppositely disposed walls of the carton to complete the set up operation.

BEST MODE OF CARRYING OUT THE INVENTION

Figure 2:
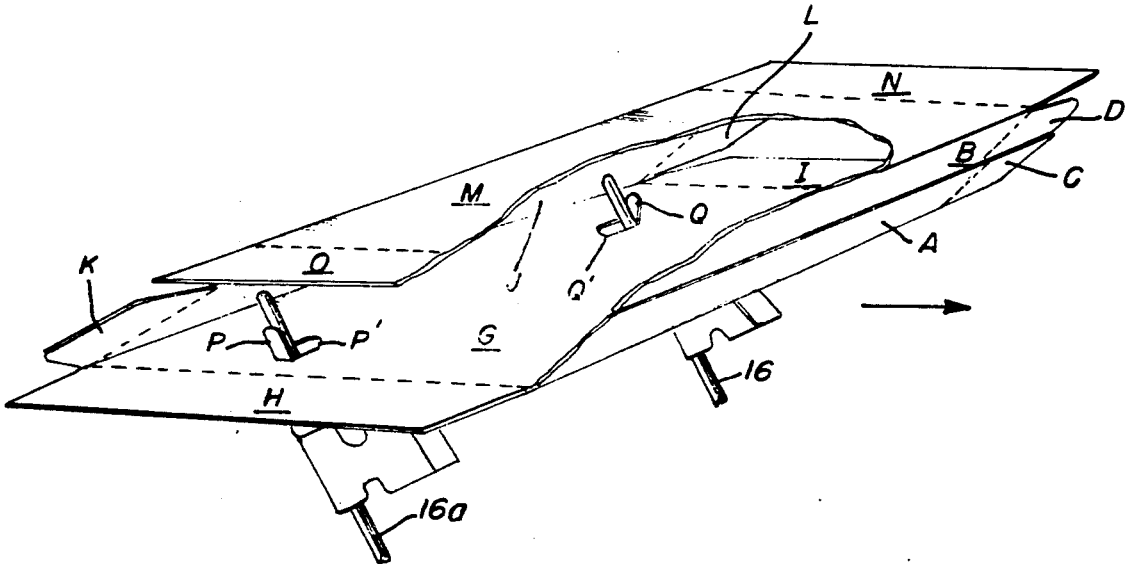
FIG. 2 is a perspective view of an open ended sleeve type carton in partially set up condition and which shows a pair of elongated rods projecting through apertures formed in an exposed wall of the carton and which shows the elongated rods in engagement with a face contacting wall of the carton.
Figure 5:
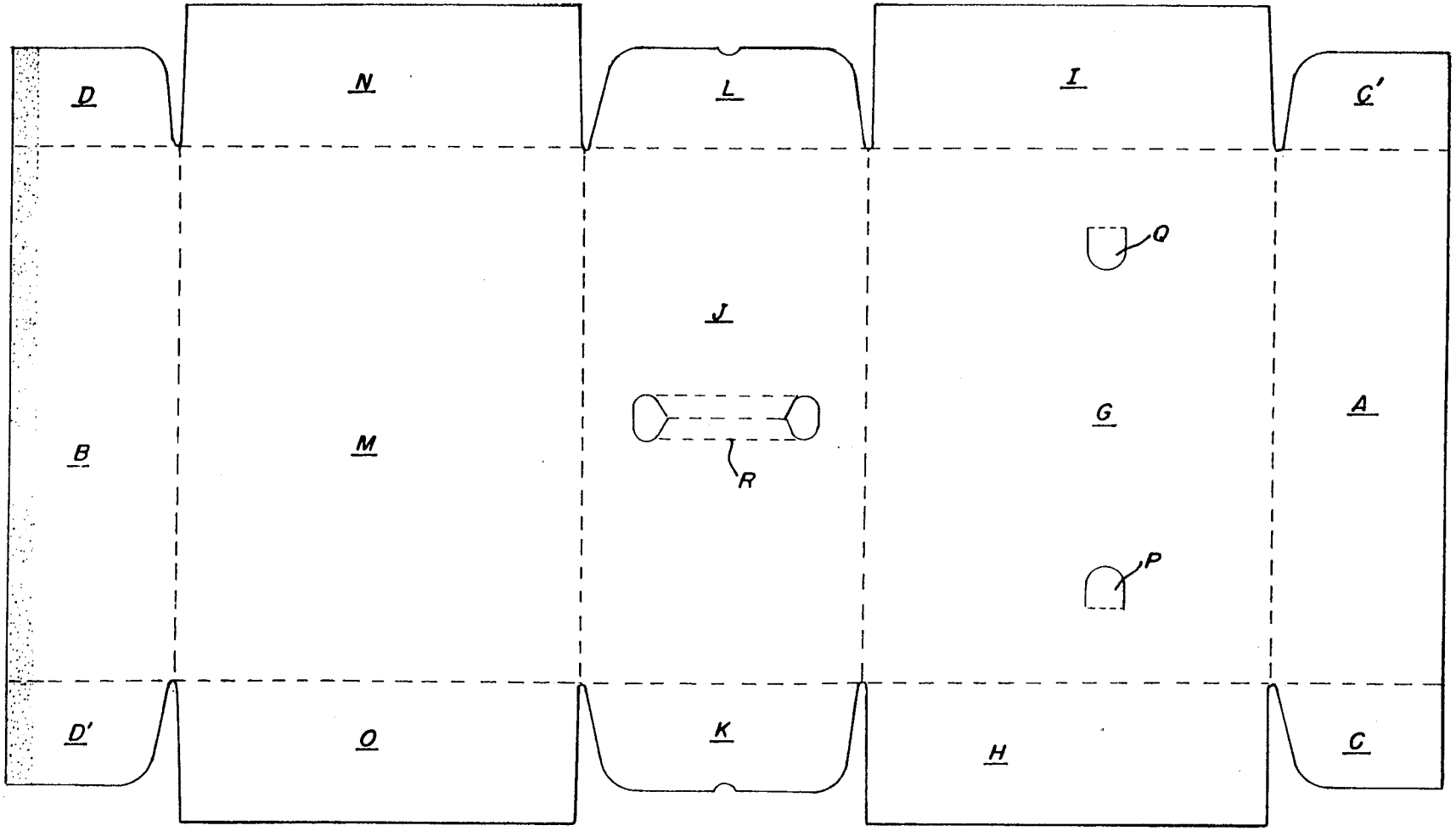
FIG. 5 is a plan view of a blank as viewed from the inside of a can carton formed according to this invention.

As shown in FIG. 2 a sleeve type can carton of the type to which this invention is applicable includes a bottom wall made up of over lapping glued panels A and B. End flaps C and D are foldably joined to one end of the bottom wall and end flaps C' and D' not shown in FIG. 2 but shown in FIG. 5 are foldably joined to the other end of the bottom wall. Side wall G is exposed to view when the carton is in the hopper and end flaps H and I are foldably joined to exposed wall G. The top wall is indicated at J and end flaps K and L are foldably joined to the end edges of top wall J while side wall M and end flaps N and 0 are foldably joined.

In accordance with this invention, a pair of Ushaped tabs P and Q are struck from side wall G and define apertures P' and Q'.

In accordance with a feature of this invention, carton pick up means is slidably mounted on elongated rods so that when exposed wall G is drawn downwardly out of the hopper and slidable along elongated rods, these rods enter the U-shaped apertures P'0 and Q' defined by tabs P and Q and engage the inner surface of top wall J which is initially disposed in flat face contacting relation with exposed side wall G. By this means, a set up operation is initiated.

Figure 1:
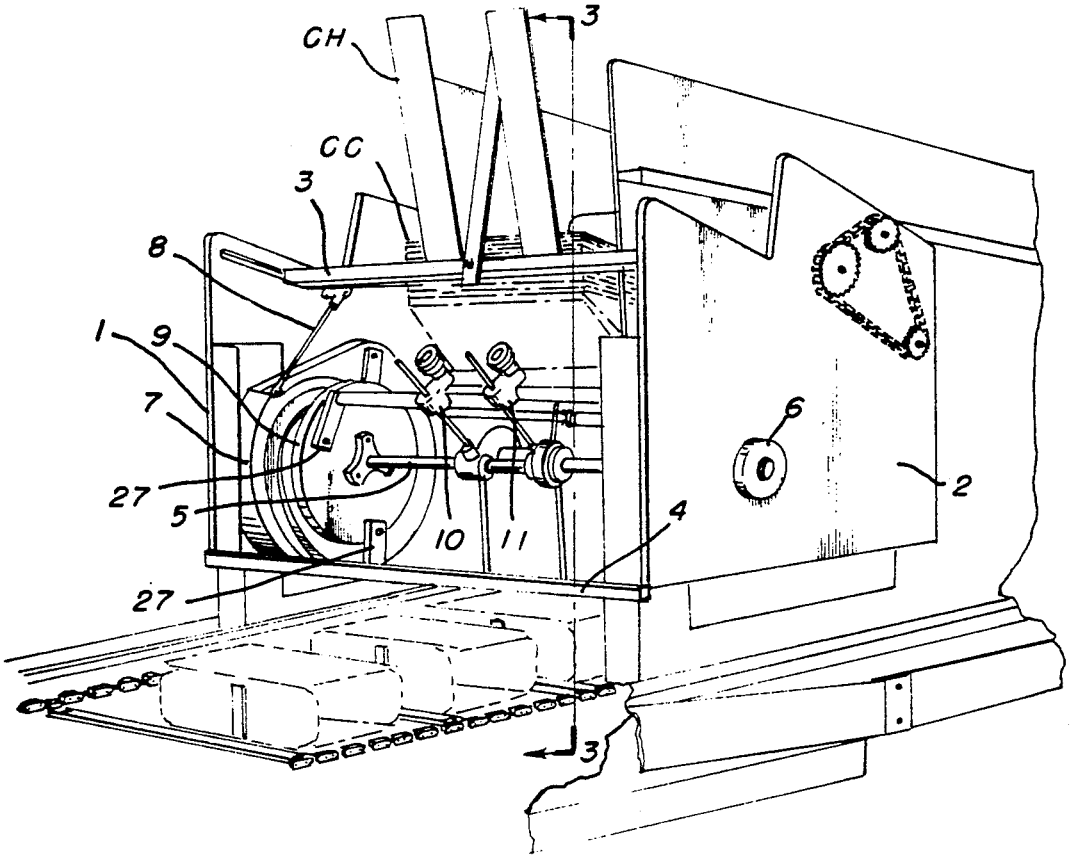
FIG. 1 is a perspective view of a packaging machine constructed according to this invention.

With reference to FIG. 1, a pair of side frame support panels 1 and 2 are shown interconnected by a transverse pair of rods 3 and 4. Rods similar to 3 and 4 are interconnected with the side support panels 1 and 2 at the right hand edges of these panels but these rods are not shown in FIG. 1.

The carton hopper generally designated at CH is supported by suitable structure mounted on side support panels 1 and 2 and a group of collapsed cartons are shown in the hopper and are designated at CC.

The feeder mechanism formed according to this invention includes a rotatable shaft designated by the numeral 5 which is journalled in bearing structure 6 suitably mounted in side panel 2. Drive shaft 5 is driven by suitable known mechanism mounted on the far side of support wall 1 but is not shown in the drawing. A fixed cam plate 7 is mounted on the inner surface of side support plate 1 and is adjustably positioned on side plate 1 by a turnbuckle designated by the numeral 8. Fixed cam plate 7 is provided with an aperture not shown through which drive shaft 5 extends. A rotatable plate 9 is fixedly secured to drive shaft 5 and is rotatable therewith. Rotatable plate 9 is disposed in close proximity to fixed cam plate 7.

Figure 3:
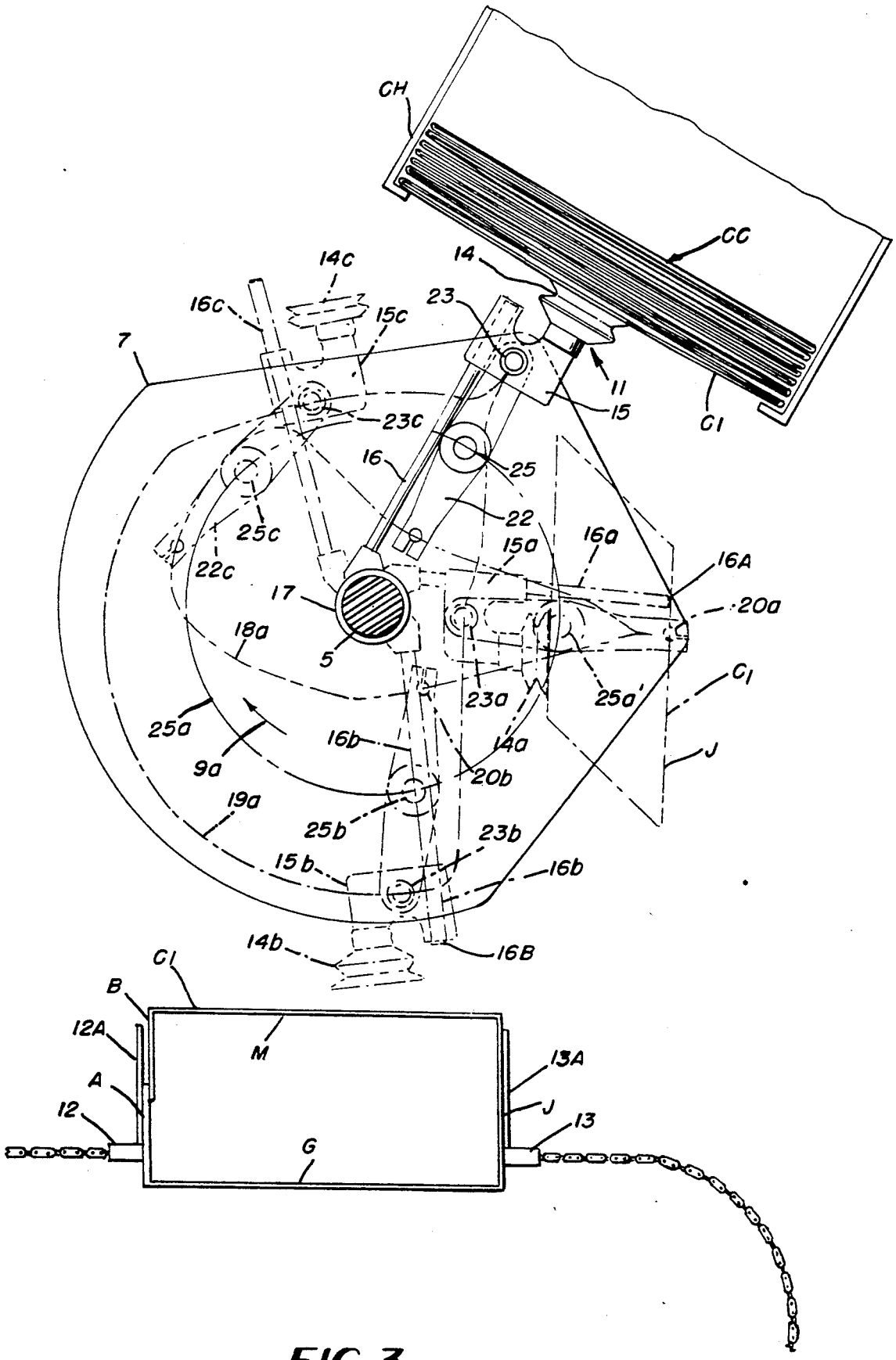
FIG. 3 is a cross sectional view of the machine taken along the line designated 3—3 in FIG. 1.
Figure 4:
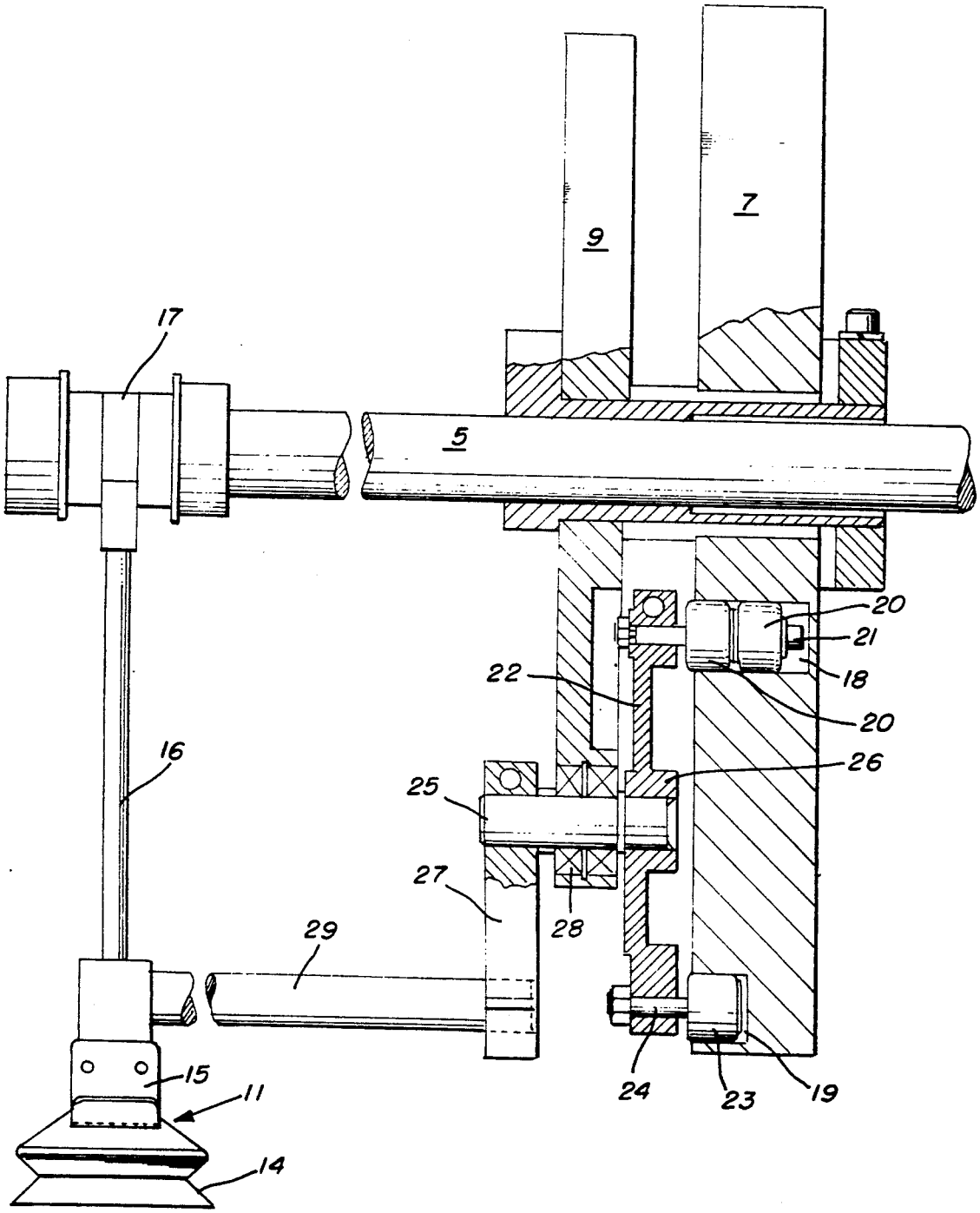
FIG. 4 is an enlarged view partially in section of carton pick up means and its cam operated control system.

For withdrawing the lowermost collapsed carton from the hopper H, a pair of pick up devices 10 and 11 are rotatable about shaft 5 as an axis and are arranged sequentially to engage and withdraw cartons while simultaneously initiating set up thereof by cam operated means shown in FIGS. 3 and 4 which show only a single pick up means and associated structure although in practice a plurality of pick up means and associated structures ordinarily are used.

Suitable flight bars of known construction are movable from right to left as viewed in FIG. 1 and a pair of partially set up cartons are shown in phantom lines between leading and following flight bars and set up operations are thus completed. Leading flight bar 12 and its finger 12*a* and trailing flight bar 13 and its finger 13*a* are shown in connection with the final set up condition of carton Cl in FIG. 3 in which the carton Cl is shown with its side wall G at the bottom of the carton.

With reference to FIG. 3, one pick up means such as that indicated by the numeral 11 is shown in solid lines at the instant of engagement with the lowermost carton Cl in carton hopper CH. The other three views of pick up device 11 and associated structure are shown in phantom lines and simply illustrate the manipulation of the parts as a feeding operation progresses.

In FIG. 3, fixed cam plate 7 is shown in outline form along with rotatable drive shaft 5. Rotatable plate 9 is not shown in FIG. 3.

As shown in FIGS. 3 and 4, feeder mechanism 11 includes a vacuum cup 14 mounted on cup holder 15 which is slidably disposed on an elongated support rod 16. Vacuum pressure is supplied by known means not shown to cup 14. The end of elongated support rod 16 which cooperates with drive shaft 5 includes a collar structure 17 which is disposed about the drive shaft 5.

For the purpose of manipulating the elongated support rod and the associated pick up device 11, suitable cam mechanism is provided and includes a deep cam track 18 best shown in FIG. 4 and a shallow cam track 19. Dual cam rollers 20 are disposed in deep cam track 18 and are rotatably mounted on stem shaft 21 which in turn is fixedly mounted at its left hand end as shown in FIG. 4 to cam bar 22.

In like fashion single cam roller 23 is disposed within cam track 19 and is rotatable about stem shaft 24 secured to cam bar 22.

For interrelating the manipulations of cam bar 22 with elongated support rod 16 and with pick up device 11. a cam shaft 25 is fixedly mounted within the hub 26 of cam bar 22. Cam shaft 25 is rigidly secured at its opposite end to cam arm 27 and is journally mounted for rotation within bearings 28 disposed in rotatable plate 9. Cam rod 29 is rigidly secured at one end to cup holder 15 and at its other end to cam arm 27.

As is indicated in FIG. 3, a path of movement inscribed by cam track 19 is indicated at 19*a* while the path of movement of cam track 18 is designated 18*a* in FIG. 3.

The path inscribed by cam shaft 25 is indicated at 25*a* in FIG. 3 which path is simply a circle a is obvious from FIG. 4.

As viewed in FIG. 3 the direction of rotation of rotatable plate 9 is clockwise as indicated by the arrow 9*a*. Since the path of travel of the single cam roller 23 in cam track 19*a* is radially up and down while the vacuum cup 14 is engaging and picking up the lowermost carton Cl there is no rotary motion of the vacuum cup 14 during this brief period of time. Thereafter the cup holder 15 and the cup 14 are moved radially inward toward shaft 5. As the parts move from the solid line position shown in FIG. 3 to the positions indicated at 16*a* and at 14*a*, the elongated rod 16 projects through the aperture P' in exposed wall G of carton Cl and the outer end 16A of rod 16 engages panel J of carton Cl which is in opposing relation to exposed wall G whereby the set up of the carton is effectively initiated as shown by the dotted line end view of carton Cl. The cam shaft 25 following its circular path 25*a* occupies the position 25*a'* and the cam roller 23 occupies the position 23*a*. This of course is due to the divergent relationship between the cam tracks 18*a* and 19*a* as explained more fully in U.S. Pat. No. 4,625,575 issued Dec. 2, 1986 and owned by the assignee of his invention.

After the parts have moved to the positions indicated at 16*b* and at 14*b*, the vacuum cup and holder have moved radially outward and the vacuum cup 14*b* is beyond the end 16B of the elongated feeder rod 16 so that the outer end 16B of the rod 16 is not in engagement with panel J of the carton Cl. At this point, the vacuum pressure is cut off and the carton is deposited between a leading flight bar such as 12 and a trailing flight bar such as 13 and a continuation of the set up operation is thus effected so that the carton Cl appears as shown in FIG. 3.

Following deposit of the carton such as Cl between the flight bars 12 and 13, the movement of the rotatable plate 9 continues and the parts are manipulated through the position represented at 14*c*, 16*c*, 22*c* and ultimately into the pick up solid line position of the parts represented in FIG. 3.

The U-shaped tabs P and Q are engaged by articles inserted from the ends of the carton and are pushed back into the plane of wall G so as to enhance the appearance of the completed package.

Figure 6:
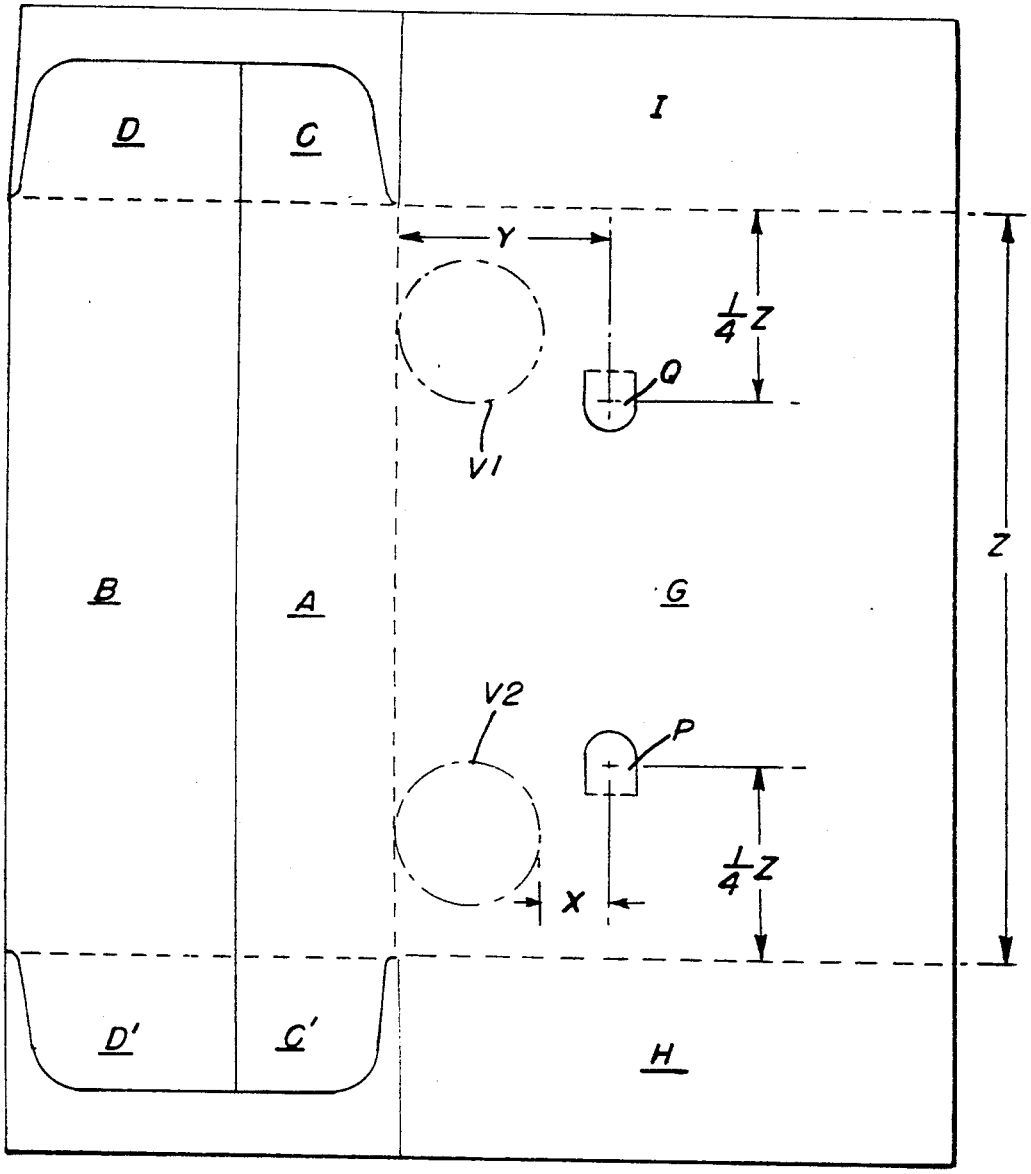
FIG. 6 is a view of the blank of FIG. 5 after the blank is formed into collapsed condition.

The carton shown in FIG. 2 is for packaging cans. This carton is more fully disclosed in FIGS. 5 and 6 and the identification of features of the carton blank are indicated in FIG. 5 by the same reference letters as are used in FIG. 2. The only addition to FIG. 5 is the designation of the handle structure which is designated in FIG. 5 by the letter R. In order to manipulate the blank of FIG. 5 into collapsed condition for mounting in the hopper CH, an application of glue is made to the inside surfaces of bottom wall lap panel B and to the edges of end flaps D and D' as indicated by stippling in FIG. 5. In order to manipulate the blank of FIG. 5 into the collapsed condition represented in FIG. 6, the wall G together with bottom lap panel A are elevated and folded toward the left along the fold line adjoining side wall G and top wall J. Following this folding operation, the bottom wall lap panel B is elevated and folded to the right along the fold line adjoining lap panel B and side wall M into flat face contacting relation with the adjacent edges of lap panel A and of end flaps C and C'. The carton then appears as shown in FIG. 6. When mounted in the hopper CH, the carton side wall G is set forth in the claims as a first exposed wall and the bottom wall formed of lap panels A and B is referred to as a second exposed wall.

The apertures P' and Q' are spaced apart by a distance which corresponds with the space between support rods 16 and 16*a*.

As is indicated in FIG. 6, the distance X between the center line of an aperture such as P' and the adjacent edge of the point of contact between the associated cup and the exposed wall G preferably is within the range ⅜ths to ⅝ths inches. Also as indicated by the letter Y in FIG. 6, the space between the center line of one of the apertures such as Q' and the fold line between walls A and G may vary between 2 and 4 inches according to a feature of this invention. Also the center line of the apertures P' and Q' from the adjacent end edge of the first exposed wall G preferably is approximately ¼th the length of the first exposed wall G i.e. the distance between the fold lines adjoining the end flaps H and I and the first exposed wall G as indicated at Z in FIG. 6.

As is apparent from FIG. 5, the closure tabs such as P and Q are foldably joined to first exposed wall G along fold lines which are spaced outwardly of wall G so that inward loading of cans into the carton from each end causes the chimes of the cans to engage the closure tabs P and Q so as to fold these tabs back into the plane of the side wall G and to hold the tabs in the folded positions due to coincidence of the can chimes with the tabs thereby to enhance the appearance of the package.

The area of contact of the two vacuum cups with the first exposed wall G is indicated in FIG. 6 at V1 and V2.

Once end loading of the open ended carton is completed, the end flaps are folded inwardly so as effectively to close the ends of the carton in a manner well known in the art.

Figure 7:
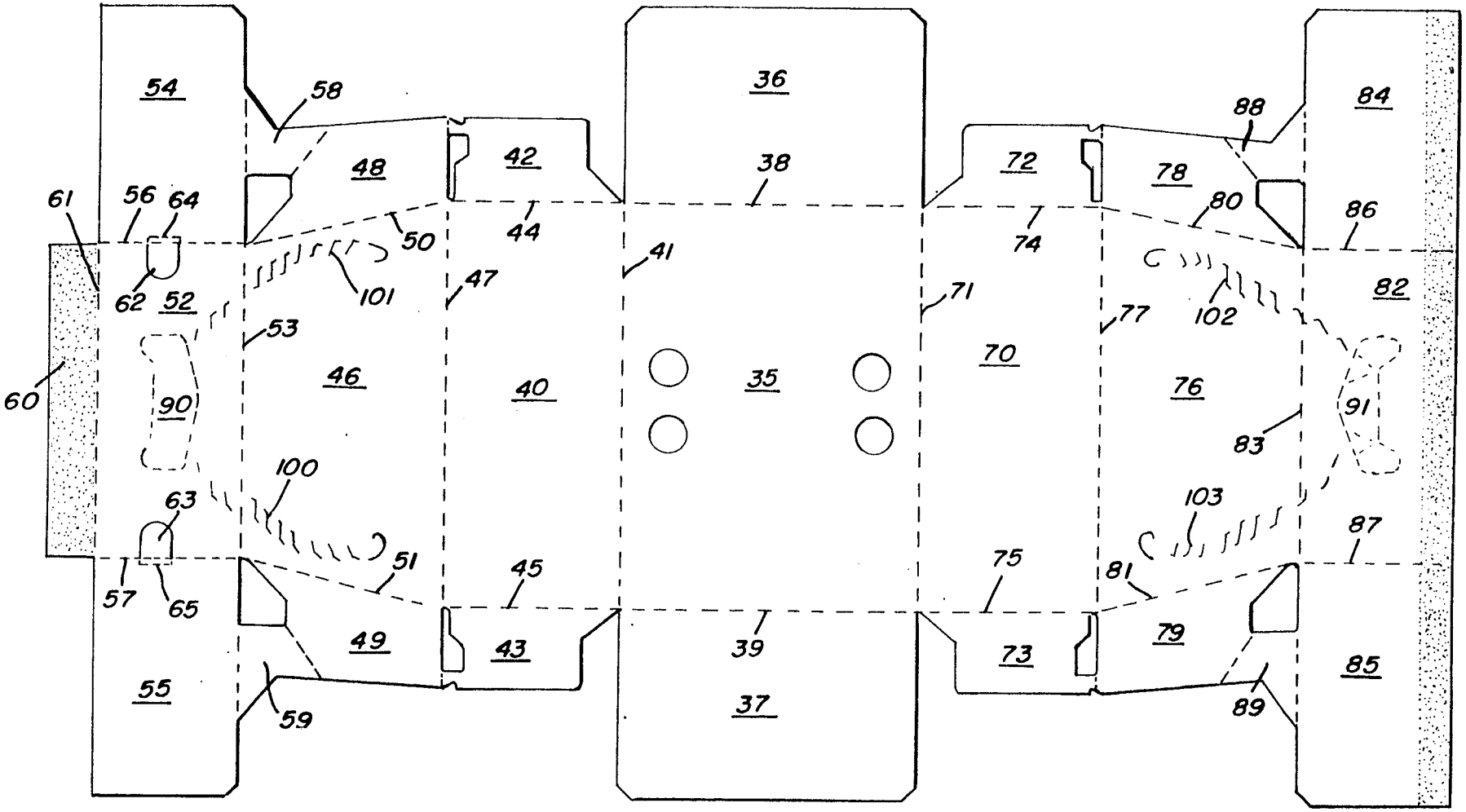
FIG. 7 is a plan view of a blank as viewed from the inside of a bottle carton formed according to this invention.

The bottle carrier blank is shown in plan view from the inside in FIG. 7. The bottom wall is designated by the numeral 35. End flaps 36 and 37 are foldably joined to the end edges of bottom wall 35 along fold lines 38 and 39 respectively. Lower side wall panel 40 is foldably joined to bottom wall 35 along fold line 41 and end flaps 42 and 43 are foldably joined to lower side wall panel 40 along fold lines 44 and 45 respectively. Upper side wall portion 46 is foldably joined to lower portion 40 of the side wall along fold line 47 and end flaps 48 and 49 are foldably joined to upper side wall panel 46 along fold lines 50 and 51 respectively. Top wall panel 52 is foldably joined to upper side wall panel 46 along fold line 53 and end flaps 54 and 55 are foldably joined to the end edges of panel 52 along fold line 56 and 57 respectively. Web panels 58 and 59 are foldably joined to panels 48 and 54 and 49 and 55 as is obvious from FIG. 7. Reinforcing panel 60 is foldably joined to top wall panel 52 along fold line 61. In accordance with a feature of this invention, closure tabs 62 and 63 are foldably joined to end flaps 54 and 55 respectively along fold lines 64 and 65 which are spaced outwardly from the adjacent fold lines 56 and 57 by a distance which may vary between ten thousandths of an inch and thirty thousandths of an inch. Viewed in another light, a carton formed according to this invention ordinarily is formed of paperboard and the outward spacing of fold line 64 from fold line 56 and of fold line 65 from fold line 57 is approximately equal to the thickness of the paperboard according to one feature of this invention.

The opposite end of the blank is similar to that just described and includes lower side wall panel 70 foldably joined to an edge of bottom wall 35 along fold line 71. End flaps 72 and 73 are foldably joined to panel 70 along fold lines 74 and 75 respectively. The upper side wall panel 76 is foldably joined to lower side wall panel 70 along fold line 77 and end flaps 78 and 79 are foldably joined to the end edges of panel 76 along fold lines 80 and 81 respectively. Top lap panel 82 is foldably joined to panel 76 along fold line 83 and end flaps 84 and 85 are foldably joined to the ends of panel 82 along fold lines 86 and 87 respectively. Web panels 88 and 89 are foldably joined to the adjacent end flaps 78 and 84 and 79 and 85 in a manner well known in the art. Also, cutaway areas are formed adjacent the web panels such as 58, 59, 88 and 89 as is obvious from FIG. 7. Also, cutaway areas are formed in end flaps 42, 43, 72 and 73 and are well known in the art. Handle flaps 90 and 91 are formed in top lap panels 52 and 82 respectively and function in a manner well known in the art.

Figure 9:
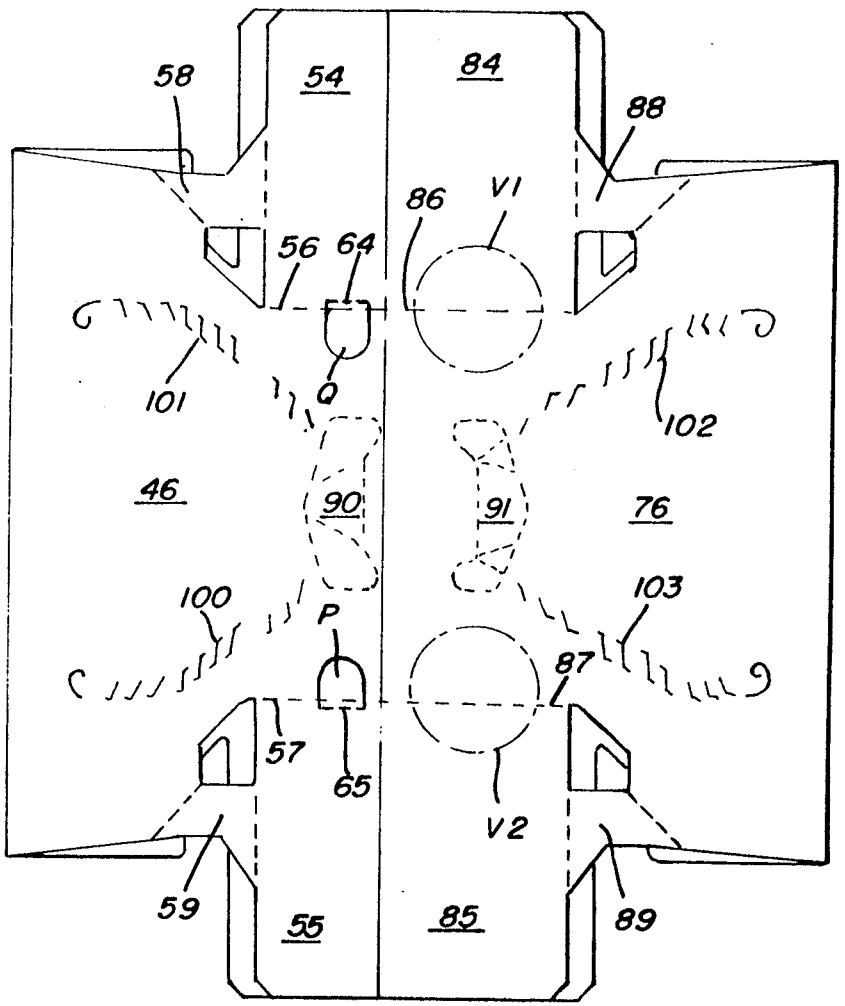
FIG. 9 is a view of the blank of FIG. 7 after the blank is folded into collapsed condition.

In order to manipulate the blank of FIG. 7 into collapsed condition as shown in FIG. 9, an application of glue is first made to reinforcing panel 60 as indicated by stippling in FIG. 7. Thereafter, reinforcing panel 60 is folded upwardly and toward the right along fold line 61 to secure reinforcing panel 60 in flat face contacting relation with the inner surface of lap panel 52 and the end of the blank then appears as shown in FIG. 8.

Figure 8:
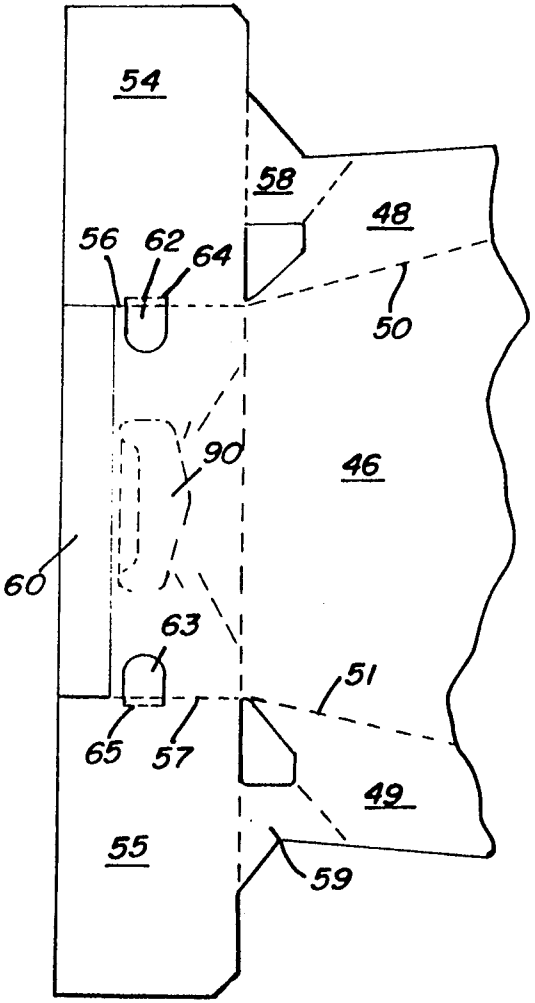
FIG. 8 is a plan view of the left hand end of FIG. 7 after folding of the reinforcing strip.

In order to manipulate the blank of FIGS. 7 and 8 into the collapsed condition represented in FIG. 9, the upper side wall panel 46, top lap panel 52, end flaps 54, 55, 48 and 49, webs 58 and 59 and reinforcing panel 60 are elevated and folded to the right along fold line 47. An application of glue is applied to top lap panel 82 and to end flaps 84 and 85 as indicated by stippling in FIG. 7. Thereafter, upper side wall panel 76 together with end flaps 78, 79, 84, 85 and top wall panel 82 and webs 88 and 89 are elevated and folded to the left along fold line 77. This operation causes the top lap panel 82 and its end flaps 84 and 85 to adhere to the edges of top lap panel 52 to reinforcing panel 60 and to end flaps 54 and 55 and the carton then appears as shown in FIG.9. Well known tear strips such as 100, 101, 102 and 103 ordinarily are provided and do not constitute features of this invention.

I claim:

1. A collapsed carton comprising a first exposed wall, a second exposed wall foldably joined along one edge thereof to said first exposed wall, an opposing wall which is disposed in face contacting relationship with said first exposed wall and a pair of apertures formed in said first exposed wall and the centers of said apertures formed in said first exposed wall being spaced from the fold line between said first exposed wall and said second exposed wall by a distance between two and four inches.

2. A collapsed carton according to claim 1 wherein the centers of said apertures formed in said first exposed wall are spaced horizontally from the end edges of said first exposed wall by a distance of approximately one fourth of the distance between said end edges.

3. A collapsed carton according to claim 1 wherein said first exposed wall has end flaps foldably joined to the end edges thereof and said apertures are closable by closure tabs foldably joined to said first exposed wall along fold lines.

4. A collapsed bottle carton according to claim 3 wherein said closure tab fold lines are spaced outwardly from the associated fold lines adjoining said end flaps to said first exposed wall by a distance between ten thousandths of an inch and thirty thousandths of an inch.

5. A collapsed carton for chimed cans formed according to claim 3 wherein said closure tabs are disposed to coincide with the chimes of cans loaded into the carton through the open ends thereof.

6. A collapsed carton according to claim 3 wherein said carton is formed of paperboard and said closure tab fold lines are spaced from the associated fold lines adjoining said end flaps to said first exposed wall by a distance slightly in excess of the paperboard thickness.

7. A collapsed carton according to claim 3 wherein said tabs are reclosed by inward loading movement of cans.

* * * * *